US006669554B1

(12) United States Patent
Tregidga

(10) Patent No.: US 6,669,554 B1
(45) Date of Patent: Dec. 30, 2003

(54) VENTILATING SILL PLATE FOR CRAWL SPACES

(76) Inventor: John Tregidga, 14241 NE. Woodinville-Duvall Rd. PMB #224, Woodinville, WA (US) 98072

( * ) Notice: Subject to any disclaimer, the term of this patent is extended or adjusted under 35 U.S.C. 154(b) by 0 days.

(21) Appl. No.: 10/227,641

(22) Filed: Aug. 26, 2002

(51) Int. Cl.[7] ..... F24F 7/00
(52) U.S. Cl. ..... 454/254; 454/276; 454/283
(58) Field of Search ..... 454/237, 254, 454/276, 283, 368

(56) References Cited

U.S. PATENT DOCUMENTS

| | | | | |
|---|---|---|---|---|
| 718,823 A | | 1/1903 | Darlington | |
| 912,823 A | * | 2/1909 | Dehn | 454/367 |
| 2,350,771 A | * | 6/1944 | Klunder | 454/276 |
| 2,565,122 A | | 8/1951 | Cole | |
| 2,861,447 A | * | 11/1958 | Leiberman | 454/185 |
| 3,192,849 A | * | 7/1965 | Massengale | 454/276 |
| 4,026,082 A | | 5/1977 | Crofoot | |
| 4,665,675 A | * | 5/1987 | Kelly | 52/534 |
| 4,794,852 A | * | 1/1989 | Ee | 454/271 |
| 5,444,947 A | | 8/1995 | Miller | |
| 5,487,701 A | | 1/1996 | Schedegger et al. | |
| 5,496,213 A | | 3/1996 | Miller | |
| 6,302,785 B1 | | 10/2001 | McKinney et al. | |
| 2002/0026762 A1 | | 3/2002 | Charland | |

FOREIGN PATENT DOCUMENTS

FR 2.231.823 * 12/1974

* cited by examiner

*Primary Examiner*—Harold Joyce

(57) ABSTRACT

A hidden ventilating sill plate is fundamentally a new building product, installed along the top surface of the exterior perimeter foundation. It replaces the existing wood sill plate. The invention has a continuous set of air slot channels of a proscribed size perpendicular to the longitudinal axis, along its base, communicating natural air flow from the exterior to the interior of the crawlspace. The exterior side of the slot channels can open earthwards to allow the venting to be completely hidden from view, when the sill member extends out beyond the exterior face of the foundation and wall. The vent concealment feature also functions as a base to the siding and an integral drip edge. Insect mitigation is achieve by adding a mesh screen over the exterior exposed slotted openings. The preferred material for this invention is a plastic-fiber composite, allowing rot resistance, shear capabilities and, rapid extrusion or molding of the sill profile.

4 Claims, 2 Drawing Sheets

VENTILATING SILL PLATE FOR CRAWL SPACES

CROSS-REFERENCE TO RELATED APPLICATIONS

Not applicable

STATEMENT REGARDING FEDERALLY SPONSORED RESEARCH OR DEVELOPMENT

Not applicable

REFERENCE TO MICROFICHE APPENDIX

Not applicable

FIELD OF THE INVENTION

The present invention relates generally to ventilation of crawlspaces beneath buildings and more specifically to a method for using a modified sill plate as a sill, vent, and drip edge.

BACKGROUND OF THE INVENTION

Ventilation of the crawlspace beneath a building is imperative to prevent moisture build-up and consequent moisture damage to floor joists, sill plates, rim joists, floor sheathing, girders, posts, and other structural elements exposed to moisture in the crawlspace. Ventilation also helps to prevent the build-up of potentially harmiful or explosive gasses such as methane, natural, ozone, and radon gas. A variety of methods for providing crawlspace ventilation have been used since buildings have been placed upon enclosed foundations. Various regional and national building codes have been enacted over the years which govern the exact amount of venting required for enclosed crawlspaces. Customarily, venting devices for crawlspaces take two forms; the first is a rectangular opening in the concrete, block, brick, or masonry wall hereinafter called a "foundation wall." The second form is a rectangular opening in the rim joist between the top of the sill, sole, or mud plate hereinafter called a "sill plate," and bottom of the floor sheathing.

Although efficiently serving their intended purpose for more than 100 years with only minor improvements, the unsightly partial prior art venting devices nevertheless suffer from a set of drawbacks.

A rectangular foundation vent box is disclosed in U.S. Pat. No. 5,444,947 (Miller) and is typical of the latest design and technology of rectangular vents. Millers' vent can be used in many applications other than just foundations, due to its unique features. However, it is still a rectangular vent and as such is very difficult to both hide it from view and obtain continuous uniform cross ventilation. Construction standards over the past 50 years have created a standard size of rectangular vents which is on the order of eight inches tall by fourteen inches wide. The design idea is to allow it to fit between framing members, which generally are sixteen inches on center or, greater. This puts them in our direct line of sight with no simple way to hide or conceal them. For example, rectangular vents in the foundation must be located far enough above the existing finished exterior grade to prevent surface water from leaking into the crawlspace, such that there is a plurality of exposed rectangular vent openings along the periphery of the exterior foundation. Furthermore, said vent's dictate the distance from the finished interior floor to the exterior finished grade. Whereas, building codes dictate a separation from the finished grade to the wood structure above, in the range of six to eight inches, that distance must be increased when using rectangular vents'. Conventional practice is to installed said vents as close to the top exposed portion of the foundation wall as possible, in order to minimize the number of steps to grade.

Additional problems arise with the installation of rectangular vents in foundation walls. They must be coordinated with the form work of the poured-in-place concrete foundation wall, the placement of the rebar steel and, the anchor bolts that tie the sill plate to the foundation. Three things that can and often do go wrong during construction. Furthermore, when vents are installed near the top off the foundation wall, structural concerns arise if point loading occurs in the same spot.

Ideally, rectangular vents must be spaced as uniformily as possible around the entire perimeter of the foundation wall in order to achieve good cross-ventilation of the crawlspace. This will exposed the vent openings in locations that are difficult to conceal. Various attempts to hide them have included the use of plants, decorative vent covers, berming of soil, and pressure treated vent-well boxes. These attempts have proven prohibitively expensive, difficult to install and maintain, and reduce the required trough air flow. Additionally, a vent will compete or conflict with other building elements for the same space, such as; concrete patios', walkways, decking structures and, beams. This competition will force the grouping of many vents together in the remaining free areas of the building's perimeter. Effectively dropping the level of required cross-ventilation, thus increasing the risks associated with poorly vented crawlspaces.

Rim vents also follow the same pattern and configuration as foundation vents, offering approximately the same amount of net free air flow. They are commonly made out of wood and more typically found on flat lot buildings where the foundation either is not exposed enough or has already been poured. This puts rim vents higher up the exterior wall assembly than the alternative and does allow a significant reduction in the distance from the finished floor elevation to the finished grade. Unfortunately, rim vents must be installed in the rim, between the floor joists and conflict with the batt insulation which is usually stuffed in that same space. This will effectively reduce or block the rim vent's trough air flow. Furthermore, by placing a vent higher up the exterior wall assembly its unsightly nature is more visible. This has never been a desirable option.

If these existing venting solutions can be considered prior art, they can both be said to suffer the same fate. They are exposed rectangles which are unpleasant to look at, and offer no effective way hide them from view without impacting venting efficiency. Further, they only function as vents. The current invention seeks to replace them completely.

A sill, sole or mud plate for use along the top periphery of conventional foundations or floor slabs has existed since the invention of lumber. It has also changed little in the past centuries other than the discovery that it must withstand moisture in order to minimize rotting. The definition of a sill plate can be found in any dictionary published. *Random House Websters's Unabridged Dictionary* defines a sill plate this way; 'sill (sil), n. 1. A horizontal timber, block or the like serving as a foundation of a wall, house, etc. A conventional sill plate is generally a two inch tall by four or six inch wide piece of rot resistant or chemically treated solid lumber laid flat along the top of a foundation. However, it has no provisions for air transmission at all. Additionally, the conventional sill plate's exterior lateral face is generally flush with the front exterior lateral face of the foundation and, is designed to accept shear wall nailing of wall sheathing disposed directly above. Therefore, the traditional rectangular shape of a conventional sill plate or prior art beam, precludes any form of integral drip edge extension. It has a solitary function as a standoff attachment between the frame of a wood structure and the foundation wall below.

Accordingly, there exists a need for another natural venting solution which is both uniform along the exterior perimeter of the foundation, while being hidden from view. Combining crawlspace ventilation with a sill plate is unobvious enough to have never been considered prior to this invention. Additionally, the advent of newer composite-wood materials makes this invention more viable.

Continuous horizontal ventilation devices do exist for ventilating attics or walls. Roof eaves and ridges take advantage of openings cut along the horizontal length of said devices to provide a means for allowing uniform trough air. Many patents exist for improving the air flow while reducing pest or water mitigation. Yet, none have the need for high structural compressive strength found along the top of a foundation. Therefore, no embodiment of prior art for horizontal roof or wall ventilators could ever be used in place of a plate or sill in a building. No prior art exists for a structural ventilating device.

The closest prior art invention is found in patent application U.S. 2002/0026762, issued to Charland on Mar. 7, 2002 discloses a grooved Construction Beam. The grooves being filled with air provide vibration dampening and thus reduced noise transmission. The shallow nature of the air-filled grooves also provides thermal insulation as well as minor vent pathways within small enclosed voids like wall stud cavities. The invention relies more upon the concept of ventilation through vapor pressure which drives moisture through objects with low permeability ratings, caused by the difference in air pressure from one environment to the next. The angular grooves merely provide less resistant pathways for the vapor to exit from. This secondary effect is done only in small enough quantities to inhibit rotting of the member itself However, the invention's main emphasis is providing vibration dampening and thus reduces noise transmission due to impact loads. The grooves are not deep enough nor in the right location to provide adequate trough flow or air for an entire crawlspace. Nor was it intended, ventilation was a side effect of the noise reduction design. This invention broadly covers beams used in any alignment, horizontal or vertical as a method of noise reduction not strictly ventilation. When ventilation is mentioned, it is in combination with "insulating advantages." The predetermined configuration of groove channels and solid intermediate segments is described as a ratio of groove depth to groove width in the range of 1/6. This ratio is better suited for trapping air than trough air flow. The ratio's of 1/1 or 1/1.5 with channels perpendicular to an edge are better suited for ventilating. Additionally, this invention discloses the drawbacks of larger, deeper or more frequent grooves in that there are inherent limitations to the soft woods found in conventional construction. Hence, the ratio's delimiting the invention found within. Furthermore, this invention does not provide either an integral drip edge configuration or screening of the vent channels. The invention does not disclose a method for achieving maximum ventilation while maintaining the structural integrity of the elongated member used in compression and shear found in wall or sill plates.

Functionally, a means for ventilating under floors in a brick building was disclosed in U.S. Pat. No. 718,823 (Darlington) wherein the inventor sought a means to vent all forms of brick buildings with walls of the thickness of four inches and upward consisting essentially, in the use of bricks formed with regular parallel projections on its upper and lower sides forming air passages between bricks at the joints. However, this concept only works with brick buildings and suffers many drawbacks functionally, by codes and construction standards of today. Further, it was never intended to be used as a sill or drip edge. The drawings depict a method of construction wherein the brick wall serves as both the interior and exterior face, uncommon today, and shows no rim board for the floor system. Rim joists, required today, would effectively block such a vent pathway.

Almost all prior art for drip edge/channel systems attempts to solve the trapped moisture problem of various wall systems with some form of applied flashing or apparatus that allows water to escape the siding or wall system in such a manner that channeling water away does not damage the wood sill plates. However, this is not required if the sill plate both functions as a drip edge and is made of a preferred material that resists rotting and insect infestation.

Unfortunately, these items are rarely installed and when they are they can often be installed incorrectly. Unlike the current invention, standard drip flashing requires a higher level of skill for proper water mitigation away from the building. The proposed invention is as easy to install as the original wood sill plate. Thus, effectively making base sidewall flashing obsolete.

None of the above inventions and patents, taken singly or in combination, is seen to describe the instant invention as claimed.

BRIEF SUMMARY OF THE INVENTION

The present invention provides the function of a crawlspace ventilation apparatus with the utility of a conventional sill plate configured to function as a drip edge for the exterior walls of the building. It will also serve as an obvious place to start the wall sheathing. The combination of three building elements into one novel product is always considered an improvement in the construction industry.

The plurality of continuous lateral slot channels incorporated into the entire length of the base of the sill plate, will allow trough flow of air, naturally from the exterior atmosphere to the interior atmosphere and back out again. Creating a means by which continuous and uniform ventilation is achieved.

It is an object of the invention to provide a slightly thicker sill plate, from the slotted channel base to the opposing top face. Thus, allowing for enough integral shear nailing surface of the wall sheathing to the lateral edge of the sill plate, in addition to adequate vent channel openings. The preferred embodiment will have a horizontally extending vent hood, integral to the sill plate, that serves as both a termination base for the exterior wall sheathing, and an integral sloping drip edge designed to channel water away from itself, the wall, and the foundation.

Accordingly, it is a principal object of preferred invention to provide a minimal architectural element along the base of the exterior walls that conceals the vent slots from view, while serving as a base and drip edge. Another embodiment would be to leave the integral sill edge off the invention to allow a reduction in the material and the inclusion of a standard sill on top of the ventilator portion.

Furthermore, by using the sill location as a vent, there will be no conflict with floor joist insulation. Conventional floor joists rest upon the top surface of the sill plate with batts of insulation stuffed between the joists, extending no farther down than the base of the floor joists or top of sill plate. Therefore, a ventilating sill plate can maintain a clear, unobstructed path, unencumbered by insulation, for trough air flow of the crawlspace.

It is another object of the invention to both vent between the sill and the foundation to which it is attached, and drain water away from the foundation wall. The invention reduces the risks of moisture accumulation at this junction, with consequent potential rotting of the building frame.

Still another object of the invention is to be manufactured from a material approved to be in direct contact with masonry or soil. Materials can be but are not limited to, pressure or chemically treated woods, cedar or other rot resistant species of wood, or engineered polymer-fiber composites tested and approved for such use. The present invention can take advantage of any combination of these technologies. The preferred embodiment would be a composite material.

It is yet another object of the invention to provide a shield or barrier from pests and insects, between the exterior slotted vent openings and the interior of the crawl space, by means of a mesh screen. A wide variety of materials can be used for the screening depending on the type of pest or insects in the region, and the local weather conditions. The base slot channels make a continuous mesh simple and easy to install, with the weight of the structure helping to hold it in place.

According to a particularly preferred embodiment of the invention, using a synthetic lumber, which is a substitute for wood in areas where wood can deteriorate quickly due to environmental conditions. One such product manufactured under the trademark TREX, by Trex Company, LLC, Winchester, Va., consists of a polyethylene-wood fiber blend which is extruded into board dimensions for decking and code approved sill plate substitutions. Testing and approvals have already been secured by companies like Trex, for using their product as a sill plate in direct contact with the ground or concrete.

Another advantage of the present invention in one embodiment where the sill is manufactured from a polymer-fiber composite, is the superior lateral strength in transferring the shearing forces of the wood structure above, into the foundation. This embodiment will not fracture like conventional wood. Its plastic nature allows for greater bending stresses before failure. A feature which is usefull in higher wind or earthquake prone areas.

Additionally, the preferred embodiment of this invention utilizing a polymer-fiber composite, incorporates all the benefits of durability, termite, and rot resistance. The water impermeability feature of polymer-fiber composites, allows the current invention to act as a building drip edge for the sheathing and siding, whereas conventional wood sill plates absorb too much moisture to be effective as a drip edge. Normally, the sill plate does not extend beyond the face of the foundation, yet this invention must extend out far enough to allow the prescribed amount of net air flow, facing a downward direction. Thus the form of concealing the vent slots functions as an integral drip edge by design.

Furthermore, the costs of milling the proposed shape would be more expensive in wood than the extrusion or molding process favored by the artificial or engineered wood industry.

It is yet a further object of the invention to maintain, in any form, methods for manufacturing and milling of lumber or engineered wood products, through a set of easy, efficient and relatively inexpensive steps so as to allow manufacturing of the proposed sill vent effective in accomplishing its intended purposes.

The particular advantage with this inventive sill over traditional drip channels or foundation vents, is that installation is exactly the same as traditional wood sill plates, while making it possible to dispense partially or completely with traditional rectangular vents and drip channels.

Another embodiment of this invention is differently configured and simpler. By simply removing the drip edge hood extension, the front edge of the sill is flush with the front face of the foundation wall, as in traditional sill plates. This opens the vent slotting to view from the exterior, but that may be preferred in some forms of building sheathing and fascia, like brick or stonework. Where the siding or fascia is installed in front of the vent slots concealing them from view, allowing enough space between the material and the vent openings to maintain trough air flow.

While my above description contains many specificities, these should not be construed as limitations on the scope of the invention, but rather as an exemplification of one preferred embodiment thereof. Many other variations are possible.

These and other objects of the present invention will become readily apparent upon further review of the following specifications and drawings.

DETAILED DESCRIPTION OF THE INVENTION

Figure 1:
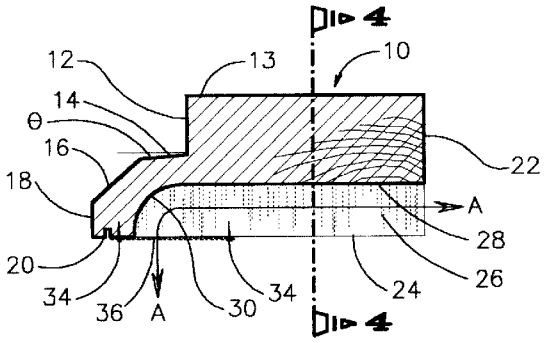
FIG. 1 illustrates a sectional cut end or side view of the ventilated sill plate with one version of the preferred embodiment drip edge.
Figure 1A:
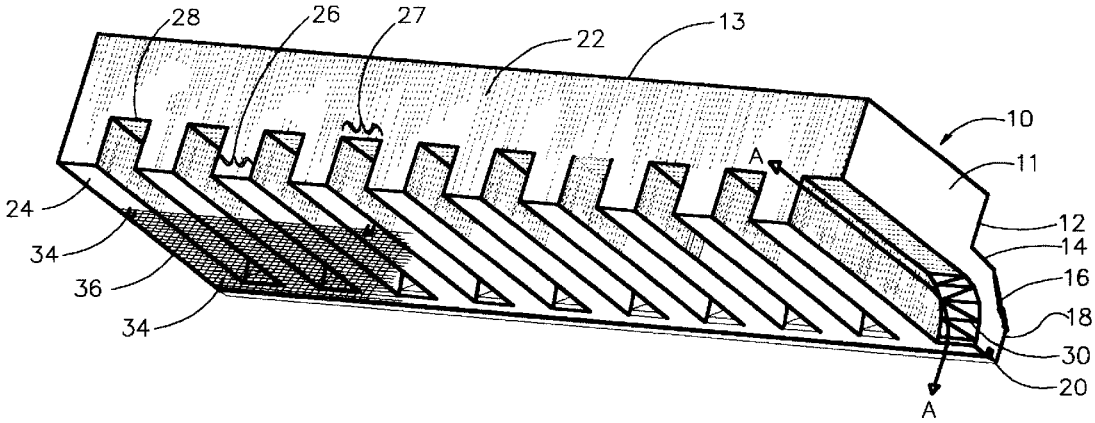
FIG. 1A illustrates an isometric view of the base of the substantially "U" shaped vent slot channels from the crawl space, showing the preferred embodiment found in FIG. 1.

Turning now to FIG. 1 & FIG. 1A, there is shown a sill plate 10 in cross section of one preferred embodiment of the present invention. The sill 10 has a generally elongated configuration defining the sill. It should be understood that the sill plate 10 could have any other suitable configuration as partially described in FIGS. 2 and 3, without departing from the scope of the present invention as long as it includes a plurality of vent slots 28 running perpendicular to the longitudinal axis, with corresponding base abutment segments 26, formed thereon.

Typically, the sill 10 defines a pair of longitudinally opposed beam end surfaces 11, (only one being shown in FIG. 1.) a pair of transversely opposed sill lateral surfaces 12, and 22, with one side 12 facing the exterior and embodying the drip edge 14 leading to the chamfered surface 16 which ties into the secondary transversely opposed sill lateral surface 18. The opposing surface 22 faces the interior of the building structure known as the "crawlspace", with the vent slots 28 and their corresponding base segments 26, shown throughout the figures as having a generally square configuration. It should be understood that the slotted base segments 26 and the corresponding slots 28, could have other configurations without departing from the scope of the invention. Defining factors would be compressive strength of the sill 10 material and net free air flow desired per running lineal foot of sill 10.

The preferred embodiment would incorporate a flat top abutment surface 13 for floor joists to rest upon, parallel to and opposing the base abutment surface 24, which rest upon the top of the foundation wall. "A" continuous longitudinal base segment 14 extending away from the lateral edge 12 at an oblique angle θ. For example, in the illustrated embodiment, the angle θ is on the order of 95 degrees. However, a variety of other oblique angles could be used including a compound steeper angle shown by longitudinal segment 16, without departing from the scope of the present invention. FIG. 1. illustrates just such a compound sloped edge 16 as a means of draining away water at approximately 45 degrees, but a variety of other angles could be used. By way of example the sill plate 10 is of integral construction and is typically made in the preferred embodiment of recycled polymer-wood fiber composite, to preserve the longevity and durability of the drip edge slope 14 and 16.

The exterior face of the sill 18 is a solid lateral surface parallel and offset from the shear nailing lateral surface 12, outward by a ratio of 1.5 times the vent channel height 28, to maintain proper venting and provide enough material for structural integrity of the face 18. It is possible for the face 18 to extend beyond FIG. 1.'s embodiment, if finish siding material thickness warrants this, as in the use of stucco or faux stone work.

Additionally, the invention embodies a shape that channels water away from the vent channels and foundation. Water drips off the bottom edge of the lateral face 18 directly to grade. To prevent water from wicking into the crawl space through the vent channels openings 27, a drip cut groove 20 runs laterally along the edge of the base 24 abutment surface exposed to the exterior, near the outer lateral face 18.

Typically, the base 24 abutment surface of the sill 10 is shaped like a plurality of the letters "T" strung substantially continuous side by side relative to each other, forming the solid portion of the vent channel segments 26. The intermediate spaces 27 between the solid "T" segments in conjunction with the abutting foundation, delimit the venting channel 27. The relationship of the solid segments 26 in the base 24 to the vent channel openings 27, is currently shown as 1 to 1. This creates a continuous running net free air flow "A" of six square inches per lineal foot of sill 10 plate. Ratio's allowing more net free air flow "A", per running lineal foot of sill 10 plate are expected by adjusting the ratio listed above and increasing either the height of the vent channel opening 28, or the width of the channel 27, or both without departing from the scope of the present invention.

Preferably, the ratio of vent channel height 28 is 33 percent of the total sill plate 10 height such that maximum ventilation of the crawlspace is achieved, while maintaining enough rigid material for the drip edge 18, drain slope 16, and drip base 14, therefore preserving 40 to 50 percent of said height for lateral nailing surface 12. In other words the overall vent height 28 directly relates to the lateral nailing surface 12 height. This will become evident in FIG. 3 and 5.

From the edge of the drip cut 20 in towards the lateral surface 22 by roughly 1/3, a mesh screen is applied directly to the abutment surface 24 to provide a pest and insect barrier 36, by means of fasteners 34, or bonding at regular intervals running longitudinally along the base length of the sill plate 10. Furthermore, the adjacent foundation abutment surface acts to secure one side of the length of the mesh screen 36. Preferably, the mesh screen 36 would be comprised of a fine stainless steel weave to prevent termites from gaining access to the interior of the crawlspace. Although, any mesh material may be used without departing from the scope of the present invention, invariably there is a direct relationship between the mesh 36 and the net free openings of the vent channels 27.

In FIG. 1., the vent channel openings 27 run perpendicular from the lateral surface 22 towards the exterior lateral surface 18, at measured intervals, define the plurality of air flow openings "A" stopping short of the drip cut groove 20 just outside the foundation wall. To avoid penetrating the sill material 10 at drip edge 16, the vent channels 27 have a radius turn 30 on the upper edge of the vent channel surface. Other embodiments which do not have the sloped drip surface 16, do not require the vent radius 30. It will become a function of the methodology of manufacturing the various embodiments that determines the shape. For example molding or extrusion will lend themselves to a radius 30, whereas milling the material does not.

Figure 2:
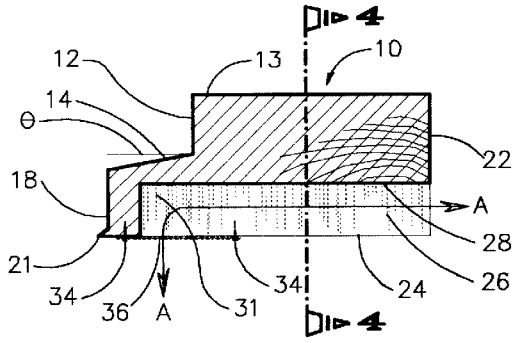
FIG. 2 illustrates a sectional cut end or side view of the ventilated sill plate with another version of the preferred embodiment drip edge.

FIG. 2 is substantially similar in scope to FIG. 1 with the exception of the vent channels 27 which do not have a radius bend, but rather a straight angle cut 31. This idea depends upon this embodiments method of manufacture, if milled and not molded or extruded, a straight cut 31 is preferred. As a result this object slopes the drip plane 14 outward towards the lateral front surface 18 at an angle θ, reasonable to achieve positive drainage of fluid away from the substructure.

Additionally, the sill plate 10 has a taller front lateral surface 18 to join directly with the sloped drip plane 14. In lieu of a drip cut, this embodiment has extending outward from the bottom of the front lateral surface 18 a drip lip 21 to break the capillary action of the water and prevent such fluids from wicking into the vent channels 27.

Figure 3:
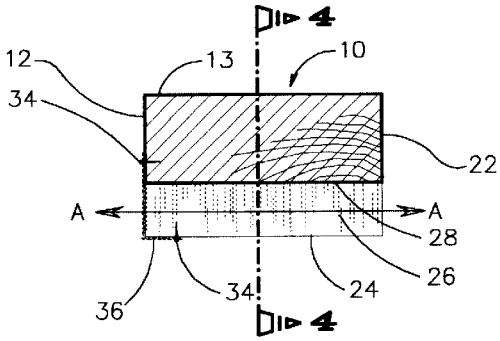
FIG. 3 illustrates an alternative sectional cut end or side view of the ventilated sill plate without the preferred embodiment of a hooded drip edge.
Figure 4:
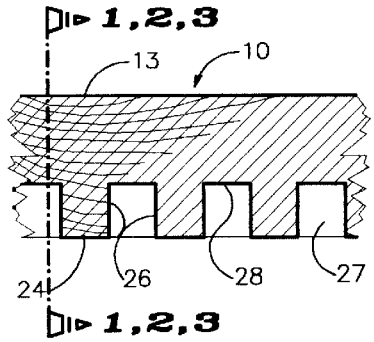
FIG. 4 illustrates a longitudinal section cut transversely through a portion of the sill plate showing a plurality of substantially "U" shaped vent slot channels and parallel intermediate solid segments.

FIG. 3 is a simplified embodiment of FIG. 1 and 2, with the vent hood and drip edge structure being left off flush with the lateral nailing surface 12 to facilitate wider finished exterior wall fascia's like brick or stone. In this case the vent screen 36 must wrap up the lateral nailing surface 12 and attach 34 to that surface as well as the abutment base 24. In this instance the vent openings "A" will be exposed unless modified trim is used to conceal the vent channels 27 from view. Nailed structural sheathing should extend down no farther than the top of the vent openings 28, so as not to obstruct the air flow "A". The height of the lateral nailing surface 12 being similar to a standard wood sill plate. The adjacent lateral surfaces 13 and 22 are similar in all embodiments. FIG. 3 represents a sill plate 10 that is most similar to existing construction practices.

FIG. 1A is an isometric view of FIG. 1 showing substantially the view of the abutment surface 24 and vent channel openings 27 with air flow "A", as viewed from the interior of the potential crawl space. Here one can see the plurality of channel openings 27 running perpendicular to the longitudinal axis, and the relationship of the mesh screen 36 as it is attached 34 to the abutment surface 24.

The channels 27 and remaining material segments 26 may be formed when using a plastic or fiber composite during the molding or extruding phase of manufacture. Conversely the same profile or shaped shown in FIG. 1A can also be milled out of the abutment surface 24 of the sill 10, with the height of the channels 28 and the width of the solid segments 26 becoming a direct function of the structural integrity of the chosen material of manufacture.

Figure 2A:
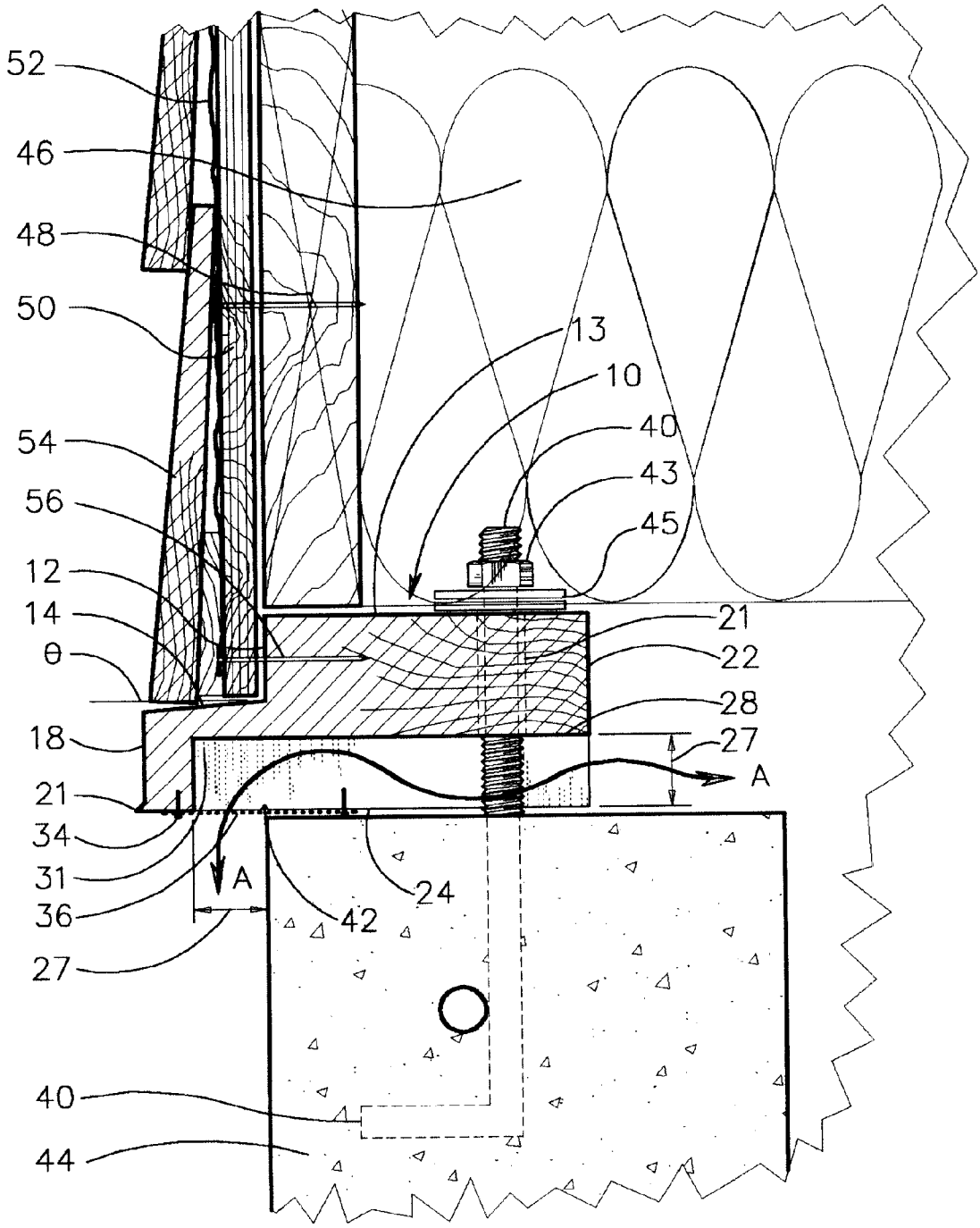
FIG. 2A illustrates the alternative preferred embodiment found in FIG. 2, showing the relationships of conventional building construction elements surrounding this invention.

FIG. 2A illustrates a sill 10 in accordance with the second embodiment of the invention shown in FIG. 2, being used as a part of a foundation, floor and wall sheathing assembly. The sill 10 is shown mounted in its preferred position laterally along the top of the masonry foundation wall 44 assembly, to better illustrate the function of the abutment surface 24 with the top of the foundation wall 44, in defining the trough air channels 27 and the passage of air "A" thru said channels. The sill 10 is also shown mounted to the top of the foundation wall 44 by means of standard anchor bolts 40 set in the masonry wall 44 prior to curing of said wall. An opening hole 21 is created in the sill 10 to facilitate the passage of the anchor bolt 40, which is typically fastened using a combination of anchor bolts 43 and anchor bolt washers 45, in order to secure the building to the foundation. The placement of the anchor bolts 40 can occur anyplace along the length of the sill 10 without departing from the inventions scope.

Preferably, the channel opening width 27 and 28 are the same at the interior of the crawlspace and the exterior of the foundation, in order to maintain the prescribed trough air flow "A". Thus a indicium or, mark 42 may be manufactured laterally along the abutting solid segments 26 to facilitate the accurate placement of the abutting surface 24 to the foundation 44. Conventional fastening means such as nails 56, attaching the building sheathing 50 to the lateral nailing surface 12, is flush with the floor system rim and joists 48, in much the same manner as conventional sill nailing. The relationship of the floor insulation 46 demonstrates little or no impact on the trough air flow "A" functioning, as it rarely is installed below the top surface 13 of the sill 10 plate. Additionally, the function of the drip edge feature of this invention can be seen clearly, as the sloping θ surface 14 carries moisture off both the finish siding 54 and the building sheathing membrane 52, down the front surface 18 and off the drip edge 21. The width of the sloping θ surface 14 can vary according to siding types and styles without departing from the scope of this invention.

The construction and use of the ventilating sill plate forming the elements of the instant invention are considered to be apparent from the above description. This instant invention constituting a significant advance in the art by the simplification and combination of heretofore bothersome and unsightly building elements, in an attractive and functional manner which insures, in the finished wall structure, a uniform and hidden venting solution.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention as claimed.

I claim:

1. A means for ventilating a building crawl space using a continuous horizontal ventilation sill member for a crawl space of a building mounted between a foundation wall and building frame structure disposed above comprising:

a. a plate of generally elongated configuration having opposed planer side surfaces, a planer upper surface, a planer rear surface, and a bottom surface, said front surface having horizontally spaced vertically upper and lower surfaces separated by and inclined drip edge surface, said spaced upper and lower surface allows the buildings sheathing and finish siding to be positioned closely adjacent to the inclined drip edge surface, said bottom abutment surface having spaced channels extending from the rear to the front surfaces, said channels are of combtooth form, wherein the smooth upper surface is in engagement with the buildings frame structure thereby supporting said structure while the channeled bottom surface is in engagement with the top of the foundation wall, whereby providing a uniform free flow of air along the path of the channels between the crawl space and the ambient environment.

2. The ventilating sill plate member of claim 1 wherein said members inclined drip edge surface extends out beyond the exterior face of the foundation wall to allow earthward facing channel vent openings to be exposed to the ambient environment.

3. The ventilating sill plate member of claim 1 wherein said member incorporating a plurality of combtooth openings along the bottom abutment surface of approximately equal width and height.

4. The ventilating sill plate member of claim 1 wherein said member may incorporate a screen mesh insect barrier over the exterior openings secured to the various channeled surfaces.

* * * * *